US007726159B2

(12) United States Patent
Gallucci

(10) Patent No.: US 7,726,159 B2
(45) Date of Patent: Jun. 1, 2010

(54) WORK TABLE FOR AN AUTOMATIC MACHINE FOR CUTTING LEATHERS AND THE LIKE

(75) Inventor: Gianni Gallucci, Monte Urano (IT)

(73) Assignee: Teseo S.p.A., Fermo (AP) (IT)

( * ) Notice: Subject to any disclaimer, the term of this patent is extended or adjusted under 35 U.S.C. 154(b) by 334 days.

(21) Appl. No.: 11/815,905

(22) PCT Filed: Feb. 24, 2006

(86) PCT No.: PCT/IB2006/000382

§ 371 (c)(1),
(2), (4) Date: Aug. 9, 2007

(87) PCT Pub. No.: WO2006/090252

PCT Pub. Date: Aug. 31, 2006

(65) Prior Publication Data

US 2008/0149003 A1 Jun. 26, 2008

(30) Foreign Application Priority Data

Feb. 25, 2005 (IT) ..... BO2005A0105

(51) Int. Cl.
*C14B 1/26* (2006.01)

(52) U.S. Cl. ..... 69/2; 69/19

(58) Field of Classification Search ..... 69/2, 69/19, 19.1, 19.3; 108/3, 50.01, 54.1, 67, 108/77, 78

See application file for complete search history.

(56) References Cited

U.S. PATENT DOCUMENTS 3,158,112 A * 11/1964 Smith ..... 108/36
4,064,814 A * 12/1977 Pokorny et al. ..... 108/64
4,333,731 A * 6/1982 Schindlmayr et al. ..... 8/436
4,840,340 A * 6/1989 Gustafsson et al. ..... 248/240.4
6,293,677 B1 9/2001 Gallucci
6,786,161 B2 * 9/2004 Fischer ..... 108/50.01
6,820,563 B2 * 11/2004 D'Urbino et al. ..... 108/77
7,168,372 B2 * 1/2007 Fotia ..... 108/80

FOREIGN PATENT DOCUMENTS

EP 0957179 A 11/1999
EP 1178120 A 2/2002
FR 565551 A 1/1924

OTHER PUBLICATIONS

International Search Report.

* cited by examiner

*Primary Examiner*—Shaun R Hurley
(74) *Attorney, Agent, or Firm*—William J. Sapone; Coleman Sudol Sapone P.C.

(57) ABSTRACT

A work table for an automatic machine for cutting leathers and the like, includes a plurality of holes opening outwards and communicating with a vacuum source, to make portions of leathers to adhere to the active surface (3) of the work table (1). The work table (1) includes a central body (1*a*), supported by a fixed structure (2). At least one lateral portion (1*h*, 1*j*), connected to the fixed structure (2), is moved by first motion means (10*h*, 10*j*) between at least one work configuration (K1), in which its active surface (3*h*, 3*j*) is aligned with the active surface (3*a*) of the central body (1*a*), to define the active surface (3) of the work table (1), and a rest configuration (K2) of reduced dimension, in which the active surfaces (3*a*, 3*h*, 3*j*) of the central body (1*a*) and the lateral portion (1*h*, 1*j*) are arranged at an angle with respect to each other.

17 Claims, 8 Drawing Sheets

WORK TABLE FOR AN AUTOMATIC MACHINE FOR CUTTING LEATHERS AND THE LIKE

FIELD OF THE INVENTION

The present invention relates to automatic systems for cutting valuable tanned leathers and the like.

BACKGROUND OF THE INVENTION

The known system for cutting fabric, synthetic materials and leathers, can be classified in accordance with the cutting technique, providing for the use or non-use of die cutters, i.e. tools, having a cutting relief or edge forming a given shape, and cuts a material giving it the contour matching the cutting relief or edge.

Die cutting machines, which mount such cutter systems, known also as die cutting machines, are widespread in the industrial manufacturing field and use, as specified, cutting means, which are shaped according to the shape to be obtained, and which must be substituted for each new production lot (size changeover).

In time, the above systems have been substituted by the ones cutting without die cutters, which work with a continuous movement of a cutting tool along the contour of the piece to be obtained, applying a highly automated computer controlled process.

The use of this technology has many advantages, such as high production rate and cutting quality, a maximum reduction of scraps and the possibility to define dynamically the cutting contour, without the necessity to substitute the tool.

For example, FIG. 1 shows an automatic machine of known type, which applies the cutting system without die cutter and which is aimed at processing tanned leathers P of large dimensions.

In a horizontal work table L, supported by a structure S, a suction effect is produced by a plurality of holes made therein, not shown, connected to a source of vacuum, likewise not shown.

A beam support M can slide in a direction Y, parallel to the longitudinal axis H of the surface L, on two straight guides G1, G2, made at the lateral ends of the structure S.

Moreover, the beam support M bears a head T, carrying cutting tools and translating, sliding on relative guides, not shown, in a direction X, perpendicular to the direction Y.

Finally, a central unit C operates the beam support M and the head T, managing the cutting of the leathers P, placed in adherence onto the work table L, in accordance with the selected shape.

The extension of the work table L allows two big tanned leathers to be placed thereon (as seen in FIG. 1): in this way, the automatic machine can perform the cutting operations on a first leather P, placed in adherence onto a first part A of the surface L, while the operators spread a second leather P on the opposite part B, making sure that each portion of the leather adhere to the surface L, with the help of suction action performed by the vacuum source.

When the cutting operations on the first leather P are completed and the second leather P is placed completely in adherence on the surface L, the second leather P is cut and the operators pick up the scraps and the pieces obtained by cutting the first leather P, and then spread another leather.

Therefore, the processing of tanned leather, described in its significant steps, is cyclical and limited by the operators' manual operations, actually longer than the automatic cutting operations.

In fact, the spreading of a leather P on the work table L and the subsequent removal of the cutting products is very difficult, due to the limited access to some portions of the leather P, situated near the longitudinal axis H, which makes the operator climb up to the surface L or use a suitable structure.

A further limit to the production rate of the above machine derives from the quality control of the leathers to be cut, which requires looking for possible imperfections on the tanned leather, and subsequent marking of faulty areas.

This visual verify takes place by putting the leather on relative trestles or when the leather is already spread on the work table L.

Possible faulty areas, marked by the operator, will be rejected during the subsequent cutting operation.

At present, the production rate of similar machines is 4-5 leathers per hour.

SUMMARY OF THE INVENTION

The object of the resent invention is to propose a work table of an automatic machine for cutting leathers and the like, which allows the operators to control, to spread the tanned leathers on the surface and to remove the cutting products in a practical, functional and easy way, thus saving time, which results in a considerable increase of the machine production rate.

Another object of the present invention is to propose a work table of simple concept and relatively cheap, taking into consideration the results to be pursued.

The above mentioned objects are obtained in accordance with the contents of the claims, by a work table for an automatic machine for cutting leathers placed on an active surface of said machine, the work table including suction means for making at least portions of said leathers to adhere to the active surface of the work table, said work table being characterized by:

a central body, supported by a fixed structure of the machine and defining a central body active surface;

at least one lateral portion, associated to said central body and provided with a lateral portion active surface;

said lateral portion being capable of moving between at least one work configuration, where said lateral portion active surface is aligned with said central body active surface, to define a maximum active surface of said work table, and a rest configuration of reduced dimension, in which said lateral portion active surface and said central body active surface are arranged at an angle with respect to each other.

BRIEF DESCRIPTION OF THE DRAWINGS

The characteristic features, not resulting from what above, will be better pointed out in the following, in accordance with the contents of the claims and with help of the enclosed Figures, in which:

DISCLOSURE OF THE PREFERRED EMBODIMENT

With reference to the enclosed Figures, the referenced number 1 indicates a work table, supported by a fixed structure 2. A suction effect is obtained by a plurality of holes, not shown, made in the work table and connected to a source of vacuum, likewise not shown, as known: see e.g. the European Patent EP 1.178.120 of the Applicant.

Figure 1:
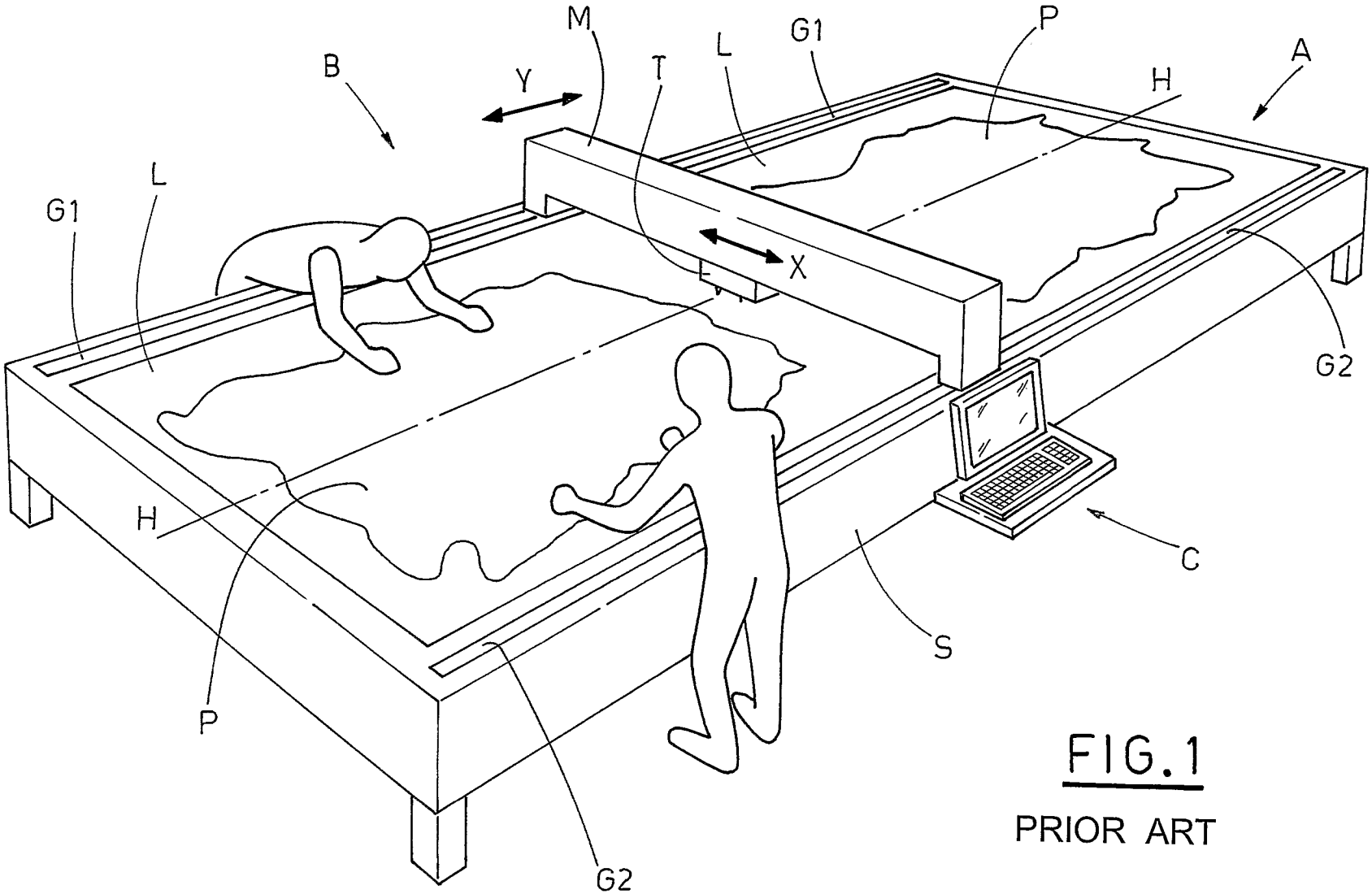
FIG. 1 PRIOR ART
FIG. 1 is a perspective and schematic view of a machine of known type for cutting large leathers.
Figure 2:
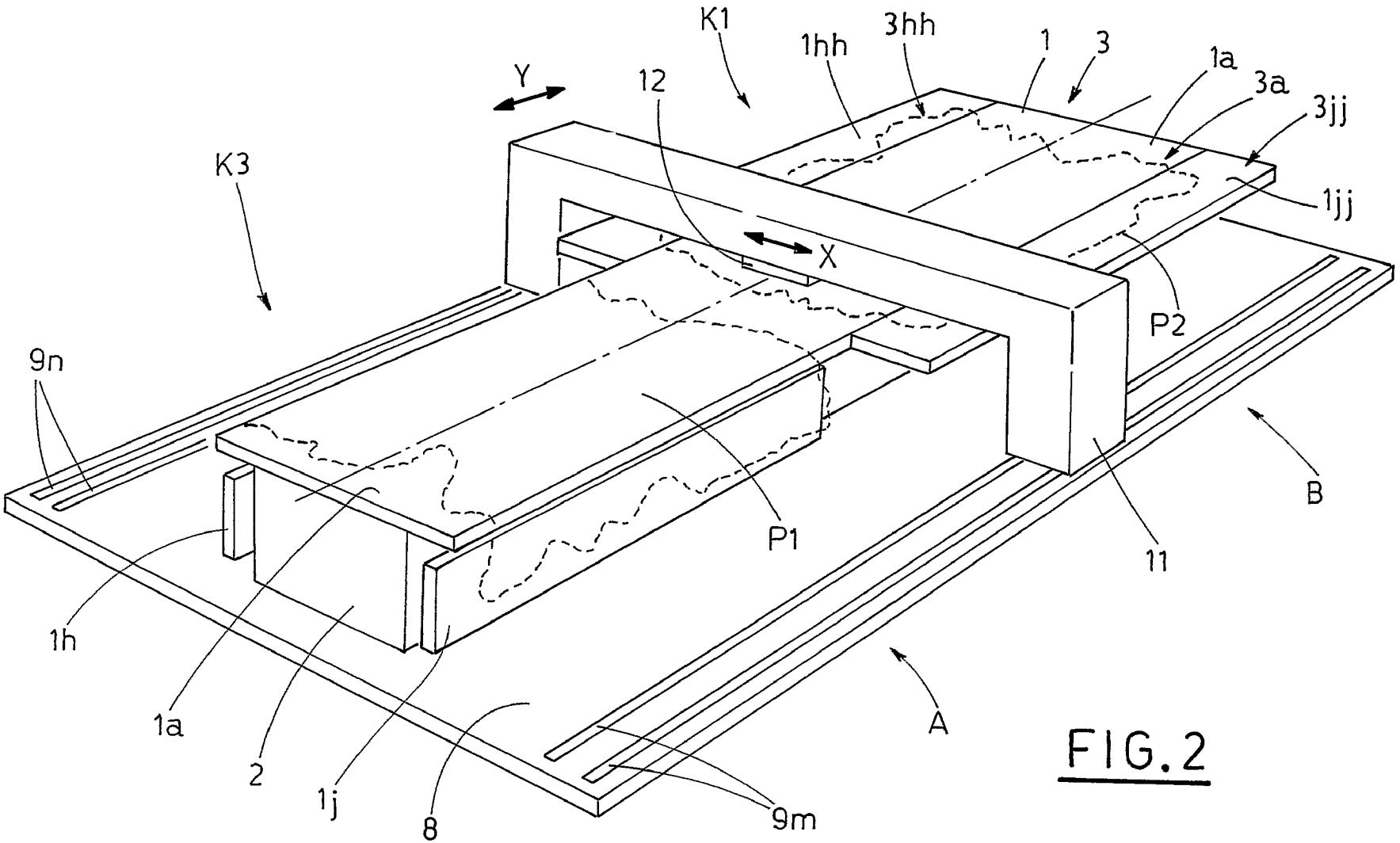
FIG. 2 is a perspective and schematic view of a machine including the work table proposed by the present invention.
Figure 3:
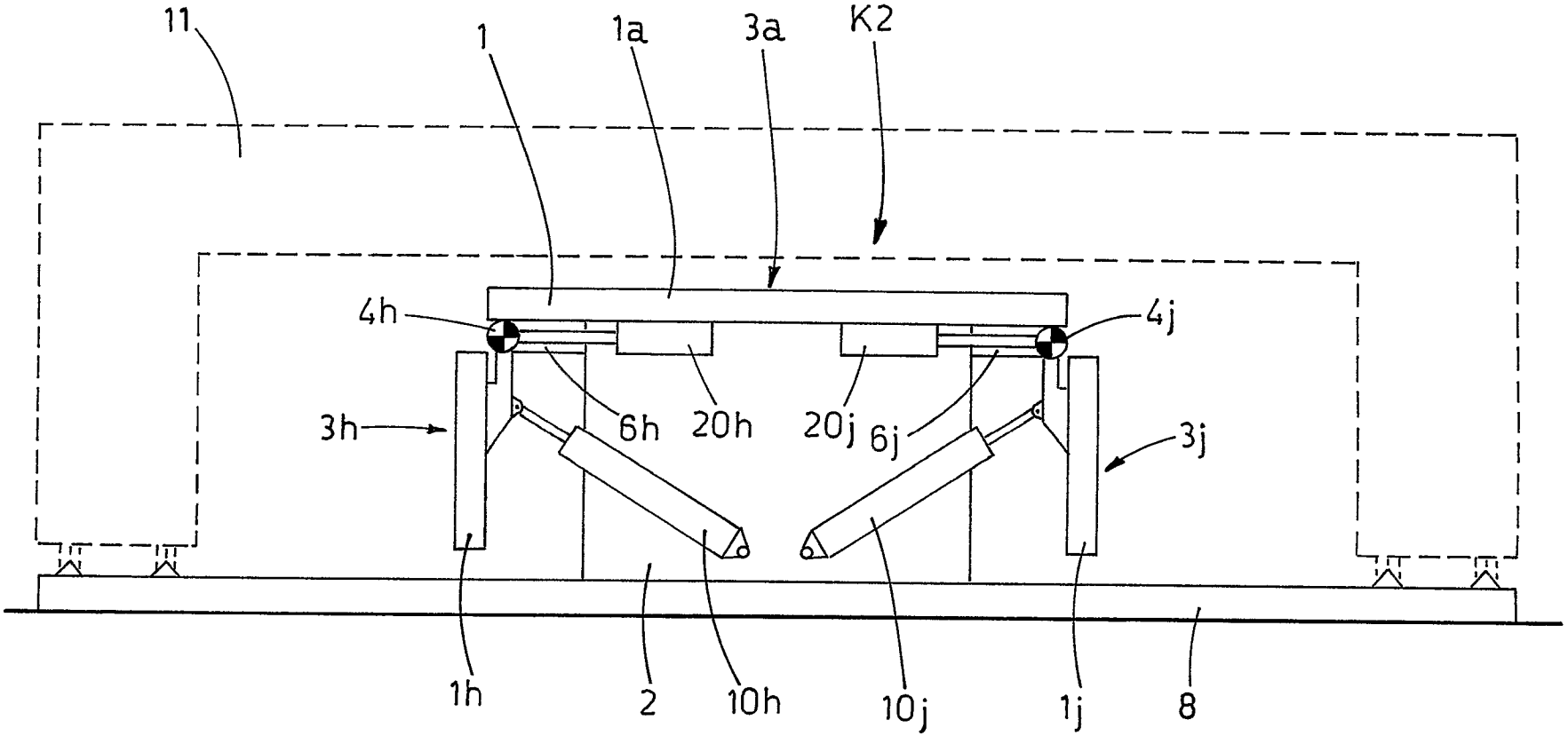
FIG. 3 shows an intermediate configuration assumed by the work table during the cyclical process performed by the automatic machine.

FIG. 2 shows a preferred embodiment of the work table 1, which includes a central body 1*a*, defined by a rectangular plate 1*a*, which has an active, flat surface 3*a* and four lateral portions 1*h*, 1*hh*, 1*j*, 1*jj*, arranged in pairs, situated at the opposite ends of the body 1*a* and defining plates featuring active surfaces 3*h*, 3*hh*, 3*j*, 3*jj*, respectively.

The latter, in some work configurations, are aimed at aligning with the central body 1*a*, defining a single, coplanar active surface 3, obtained by the joining of the active surfaces 3*a*, 3*h*, 3*hh*, 3*j*, 3*jj*.

The work table 1 has two symmetry planes, a longitudinal one and a transversal one.

In particular, with reference to the latter, it is possible to subdivide the work table 1 in a first part A and a second part B, describing e.g. only the first part A, together with the functional elements connected thereto (described later) and in accordance with FIGS. 3, 4A, 4B, 4C, 4D, 4E.

Analogous considerations are valid also extended to the second part B and to the functional elements connected thereto, as it will result clear from the following.

Each lateral plate 1*h*, 1*j*, is connected to the central body 1*a* by articulation elements 4*h*, 4*j* and is rotated with respect thereto by respective first motion means 10*h*, 10*j* (e.g. jacks).

Moreover, the articulation elements 4*h*, 4*j* can be advantageously operated, by second motion means 20*h*, 20*j* (e.g. jacks), to slide inside the horizontal guides 6*h*, 6*j*

The work table 1, proposed by the invention, is an integral part of an automatic machine for cutting leathers and the like.

Besides the work table 1, FIG. 2 shows the following parts of the cutting machine: a base 8, which supports the group formed by the structure 2 and the work table 1, and which forms, at its lateral ends, guides 9*m*, 9*n*, parallel to the longitudinal axis of the surface 1; a beam support 11, operated by drive means not shown, so as to slide on the above guides in a direction Y parallel to the longitudinal axis of the surface 1, and carrying at least one cutting head 12, which is moved (by means not shown) on the guides made in the support beam, in a direction X, perpendicular to the direction Y.

The operation of the work table, proposed by the present invention, will be described now.

As already said in the introductory note, the known automatic machines for cutting tanned leathers of large dimensions, perform cyclical operations, symmetrical on the parts A, B, forming the work table 1, therefore it is possible to take into consideration, for example, the working of only the first part A, since analogous considerations are valid also for the second part B.

Therefore, FIGS. 4A, 4B, 4C, 4D, 4E define a work cycle performed by the automatic machine on the first part A of the work table 1, shown in its important steps.

Figure 4A:
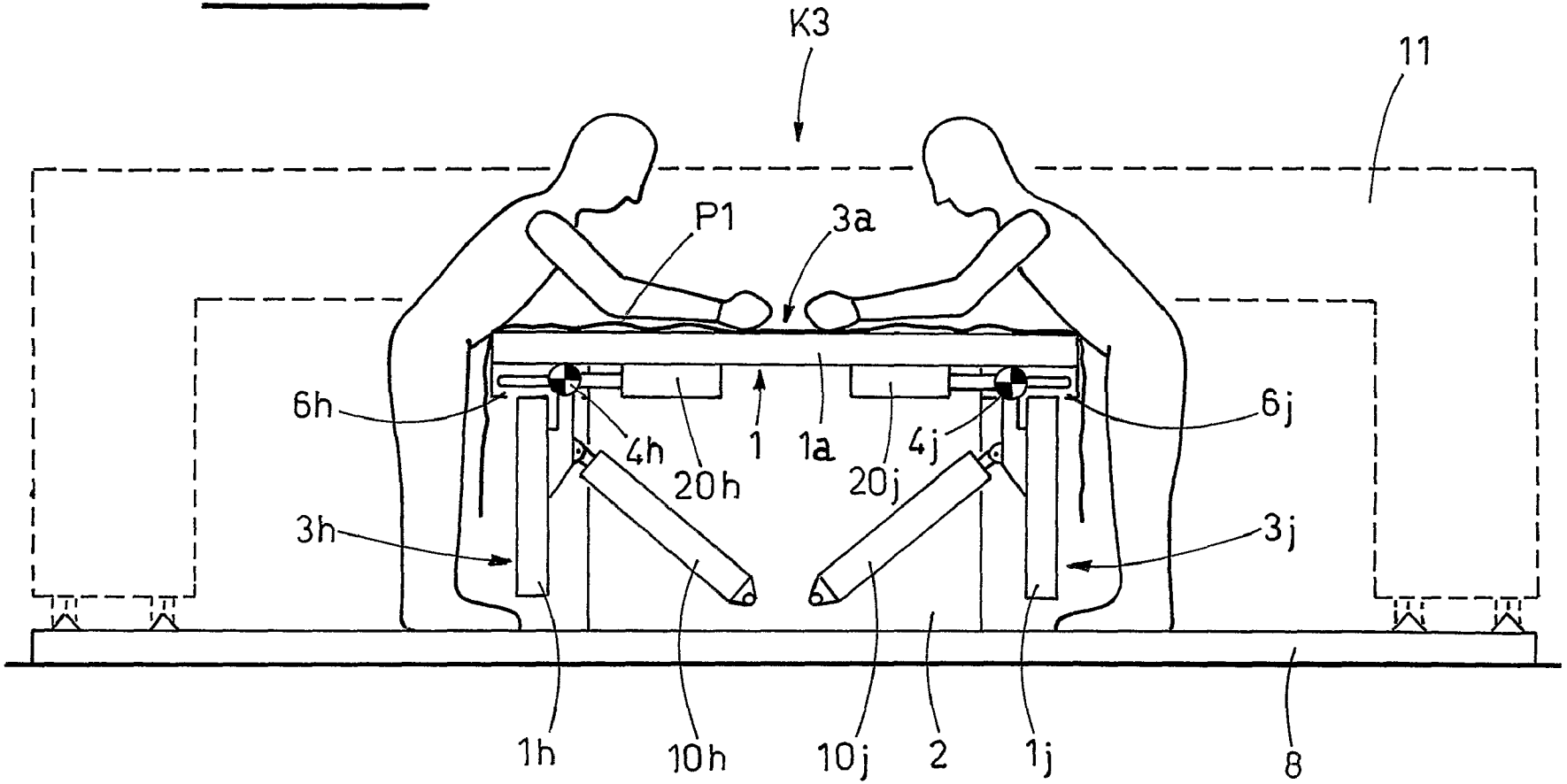
FIGS. 4A, 4B, 4C, 4D, 4E show significant steps of the working cycle performed by the machine including the proposed work table.

FIG. 4A shows the work table 1 in a rest configuration K3, of minimum dimension, in which the active surfaces 3*h*, 3*j* of the lateral portions 1*h*, 1*j* are arranged at 90° with respect to the surface 3*a* of the central body 1*a*, without protruding therefrom.

This is obtained by bringing the first jacks 10*h*, 10*j* and the second jacks 20*h*, 20*j* to a minimum extension configuration, in respective inner dead centers.

Thus, the operators, without being hindered by the lateral portions 1*h*, 1*j*, can spread the median part of the leather to be cut on the central body 1*a*, making it adhere to the active surface 3*a* and e.g. contemporarily, looking for possible imperfect areas.

As it can be seen in the Figure, the spreading of the tanned leather on corresponding portions next to the longitudinal axis of the work table 1, is performed in an easy and practical way, by the operator standing beside the work table 1. After a first part of the leather has been placed on the central body 1*a*, the second jacks 20*h*, 20*j* are operated until their shafts are brought to the maximum possible extension, which results in sliding of the articulation elements 4*h*, 4*j* on the horizontal guides 6*h*, 6*j*, and outwards translation of the lateral portions 1*h*, 1*j*, so as to define a rest configuration K2 of reduced dimension of the work table 1, shown in FIG. 3.

Later, the first jacks 10*h*, 10*j* operates the lateral portions 1*h*, 1*j* which rotates by 90° with respect to the articulation elements 4*h*, 4*j*, thus allowing the corresponding active surfaces 3*h*, 3*j* to align with the active surface 3*a* of the central body 1*a*, and defining a single coplanar surface 3 of maximum extension, formed by joining of the active surfaces 3*a*, 3*h*, 3*j* according to a work configuration K1 shown in FIG. 4B.

This figure shows also, in a schematic way, the operators, who control and make adhere the remaining part of the tanned leather on the lateral portions 1*h*, 1*j*, according to the above described way.

Figure 4B:
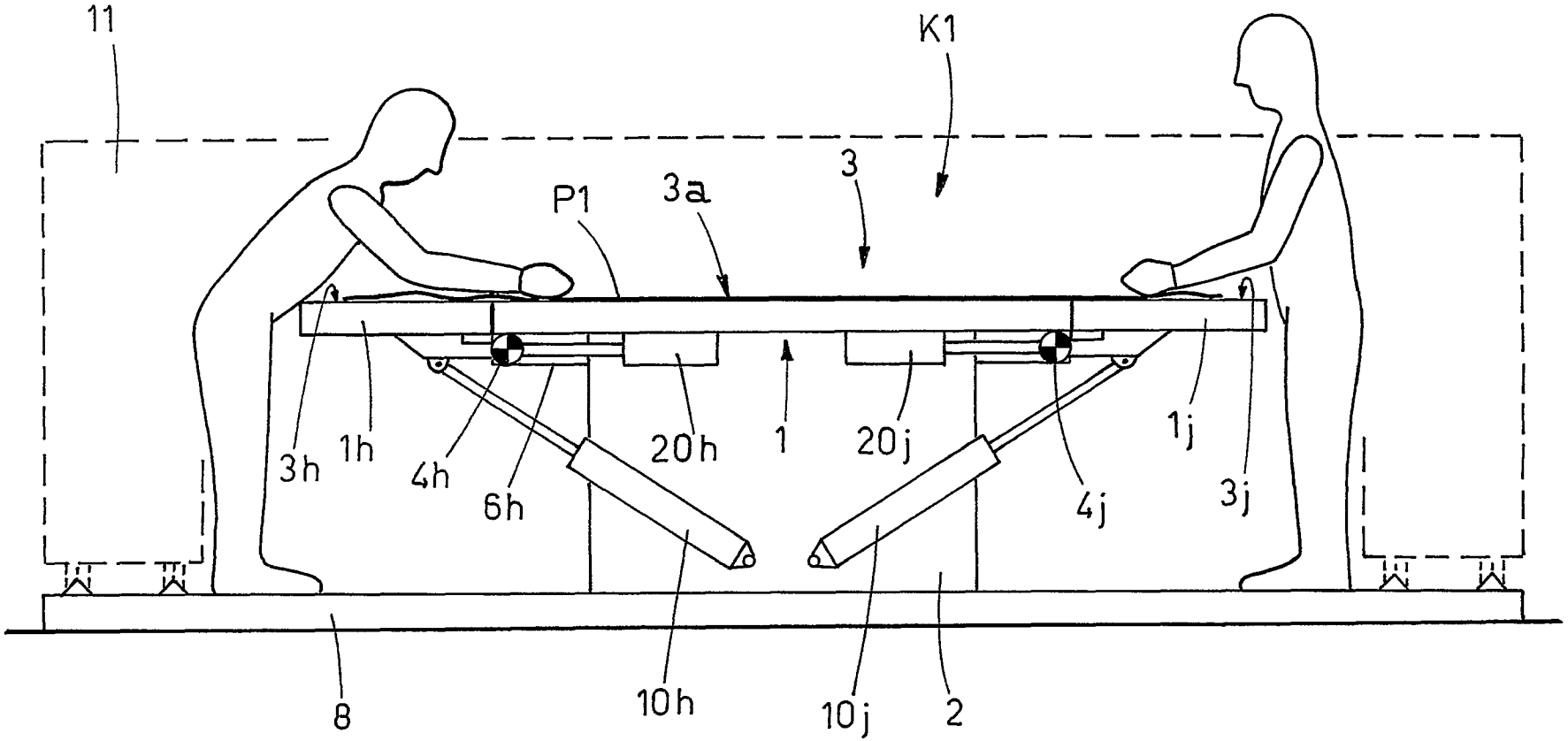
Figure 4C:
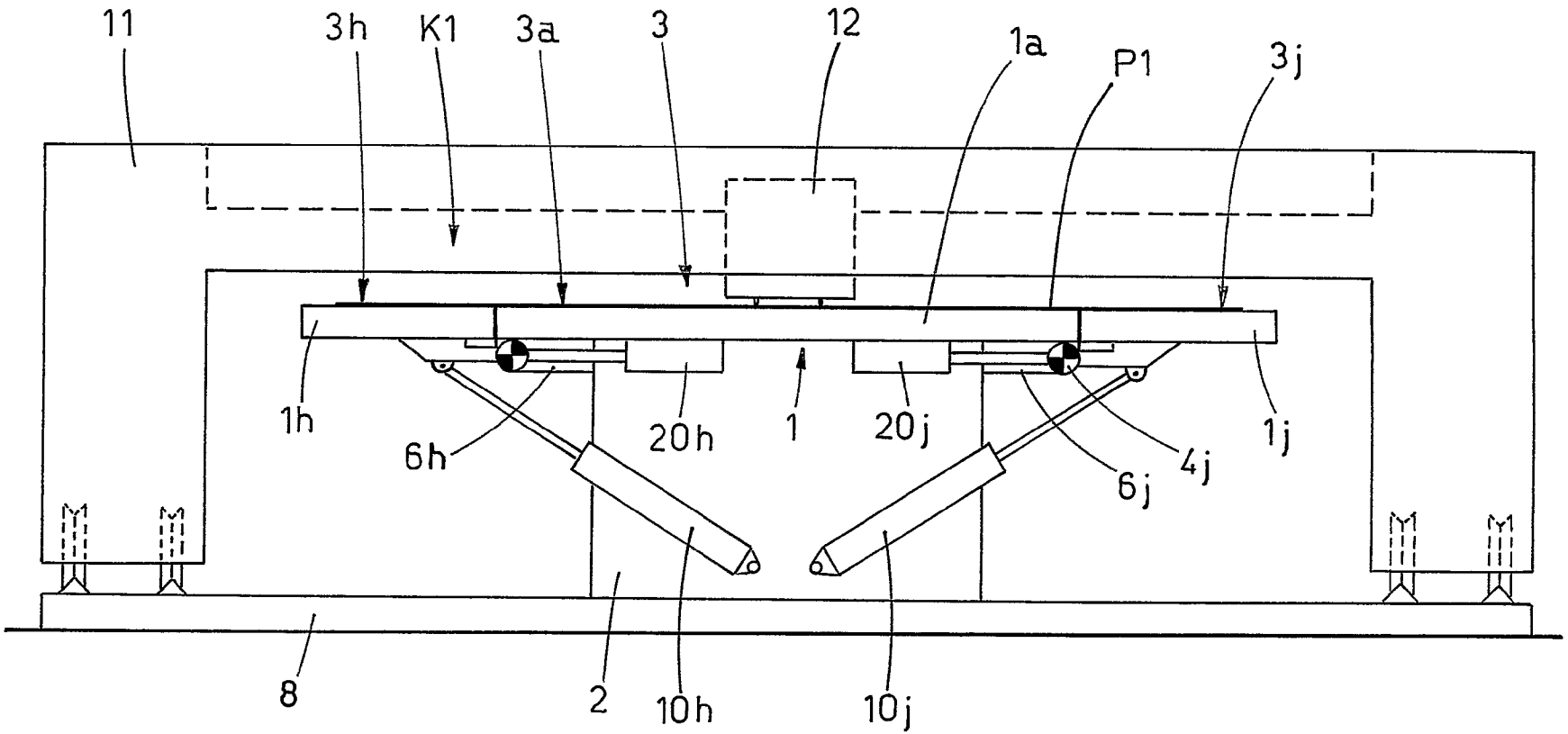

The tanned leather, spread and possibly marked by the operators, is then subjected to the cutting operations of known type: therefore, the automatic machine moves the beam support 11 and the head 12, until the latter can move on a two-dimensional plan X-Y, parallel to the work table 1, cutting the leather adhering to the first part A of the active surface 3 (see FIG. 4C).

Figure 4D:
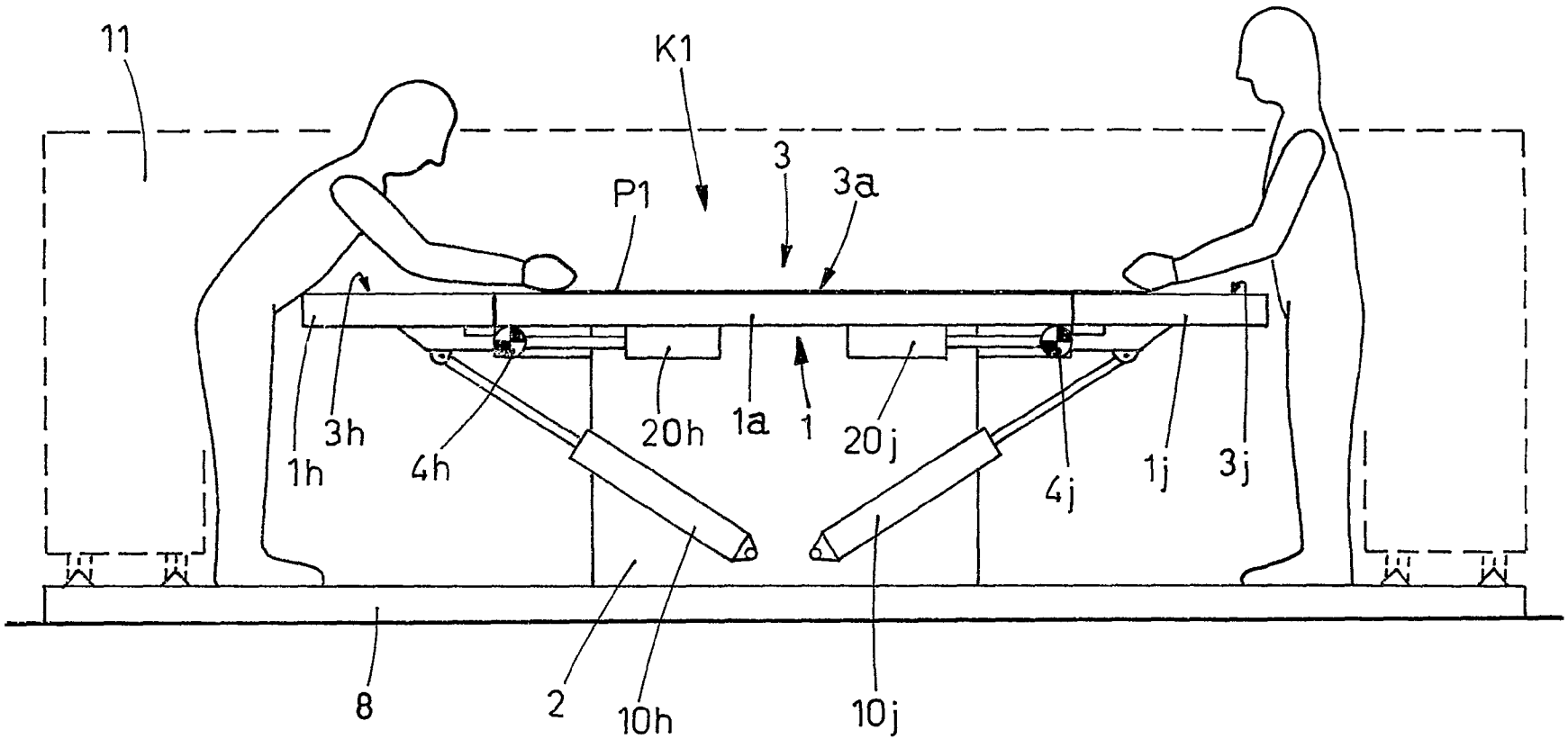
Figure 4E:
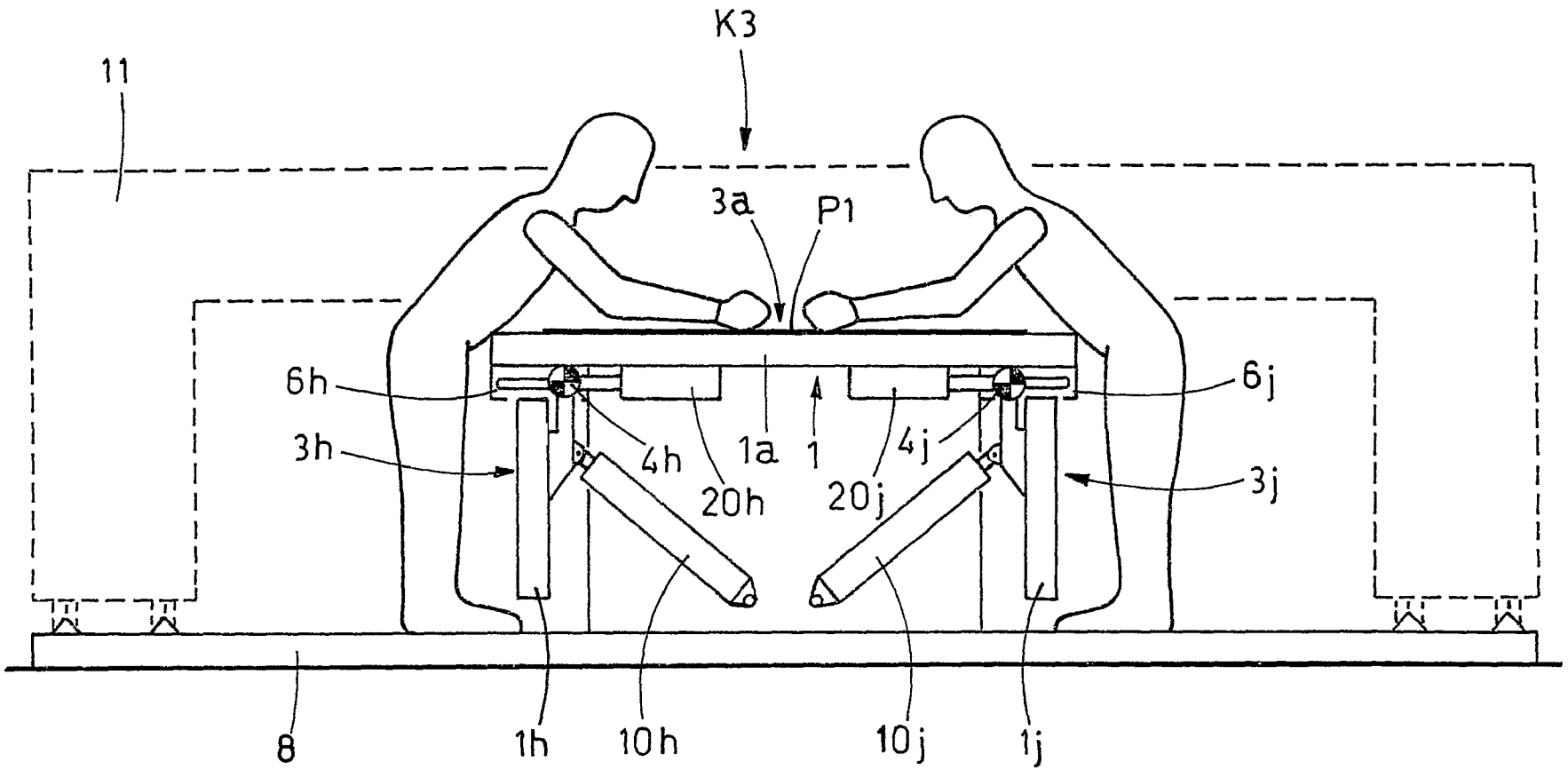

When the cutting step of the first part A is completed, finished products and scraps remain on the work table 1, to be removed by the operators first in correspondence to the lateral portions 1*h*, 1*j* with the work table 1 in the working configuration K1, see FIG. 4D, then on the active surface 3*a* of the central body 1*a*, with the surface 1 in the rest configuration K3 of minimum dimension, shown in FIG. 4E.

As already pointed out, the succession of operations shown in FIGS. 4A, . . . , 4E defines a complete work cycle performed by the automatic machine on the first part A of the work table 1.

Analogous considerations can be made with respect to the second part B of the surface 1.

Thus, the automatic machine can perform cutting operations of a first leather P1, placed in adherence to the first part A of the active surface 3 of the work table 1 (FIG. 4C), while the operators spread a second leather P2 on the second part B, analogously to what is shown in FIGS. 4A, 4B.

After having finished the cutting step of the first leather P1, the beam support 11 is brought close to the transversal symmetry plane, semifinished products and scraps are removed from the first part A (FIGS. 4D, 4E), and another leather is placed thereon, in the way described above (FIGS. 4A, 4B).

The beam support 11 remains in this configuration until the spreading of the second leather P2 and looking for possible imperfections is completed.

Afterwards, the second leather is cut, according to the selected specifics, with subsequent removing of the cutting products and scraps, and the machine is ready for a new work cycle.

Otherwise, according to another embodiment, there are no second actuating means 20*h*, 20*j* and horizontal guides 6*h*, 6*j*.

In this case, the articulation elements 4*h*, 4*j* remain integral with the work table 1 and the lateral portions 1*h*, 1*j* can rotate with respect thereto by 90° or more, to minimize their already limited lateral dimension.

Furthermore, it is possible to extend advantageously the technical-functional aspects of the present invention also to work tables with active surface smaller than the one considered above, of dimensions allowing the work of only one operator, and the use of only one plate, situated at one side of the central body 1*a*.

The advantage of the present invention, as it can be deduced from the above description, lies in the fact that it defines a working plane for automatic machine for cutting leathers and the like, which allows the operators to perform quality control, spreading and removing the tanned leather from the plane in an easy, practical and first of all, rapid way.

These advantages result in a significant production rate increase of the automatic machines using the table proposed by the invention.

With a one-beam support system, like the one described above, the removal of the products of cutting of a first leather P1, control and spreading of another leather, performed manually e.g. on the first part A of the work table 1, requires much less time than the contextual cutting operation of a second leather P2, placed adhering to the second part B of the table 1.

This allows to use automatic machines with two beam supports, one for each part of the work table 1, which results in even quadruple increase of productivity with respect to the known machines.

Another advantage of the present invention lies in the fact that it defines a work table, whose structure is fundamental, strong and which is relatively cheap, taking into consideration the obtained objects.

It is understood that what above, has been described as a pure, not limiting example, therefore, possible practical-application variants remain within the protective scope of the invention as described above and claimed below.

The invention claimed is:

1. An automatic machine for cutting leathers placed on an active surface of said machine, said automatic machine comprising:

a fixed structure (2);

a work table supported by said fixed structure and including suction means for adhering at least portions of said leathers to the active surface of the work table (1), said work table having:

a central body (1*a*), supported by the fixed structure (2) of the machine, the central body defining a central body active surface (3*a*);

at least one lateral portion (1*h*, 1*j*), associated to said central body and provided with a lateral portion active surface (3*h*, 3*j*);

said lateral portion being capable of moving between at least one work configuration (K1), where said lateral portion active surface (3*h*, 3*j*) is aligned with said central body active surface (3*a*), to define a maximum active surface (3) of said work table (1), and a rest configuration (K2) of reduced dimension, in which said lateral portion active surface (3*h*, 3*j*) and said central body active surface (3*a*) are arranged at an angle with respect to each other;

a base (8) which supports a group formed by the fixed structure (2) and the work table (1);

guides (9*m*, 9*n*) located at lateral ends on the base (8), parallel to a longitudinal axis of the central body active surface (3*a*);

a beam support located on the guides and being slidable thereon in a direction (Y) parallel to the longitudinal axis of the central body active surface (3*a*); and, at least one cutting head carried on said beam support.

2. The automatic machine for cutting leathers according to claim 1 wherein the work table includes two lateral portions (1*h*, 1*j*), made on opposite ends of the central body (1*a*) and made to move between at least one work configuration (K1), in which the relevant lateral portion active surfaces (3*h*, 3*j*) are in alignment with the central body active surface (3*a*), to define a maximum active surface (3) of said work table (1), and a rest configuration (K2) of reduced dimension, in which said central body active surface (3*a*) is arranged at an angle with respect to each of said lateral portion active surfaces (3*h*, 3*j*).

3. The automatic machine for cutting leathers according to claim 1 wherein the work table further comprises an articulation element (4*h*, 4*j*), with respect to which said lateral portion (1*h*, 1*j*) is made to rotate between said working configuration (K1) and said rest configuration (K2) of reduced dimension, in which said central body active surface (3*a*) and said lateral portion active surfaces (3*h*, 3*j*) are arranged at an angle with respect to each other.

4. The automatic machine for cutting leathers according to claim 1, wherein at least said lateral portion (1*h*, 1*j*) can be moved between said rest configuration (K2) of reduced dimension and a rest configuration (K3) of minimum dimension, defined by a smaller distance between said lateral portion (1*h*, 1*j*) and the fixed structure (2).

5. The automatic machine for cutting leathers according to claim 3, wherein a group formed by said articulation element (4*h*, 4*j*) and said lateral portion (1*h*, 1*j*) can be moved between said rest configuration (K2) of reduced dimension and a rest configuration (K3) of minimum dimension, defined by a smaller distance between said group and the fixed structure (2).

6. The automatic machine for cutting leathers according to claim 4 further comprising motion means (20*h*, 20*j*), which operate to move at least said lateral portion (1*h*, 1*j*) between said rest configuration (K2) of reduced dimension and a rest configuration (K3) of minimum dimension, defined by a smaller distance between said lateral portion (1*h*, 1*j*) and the fixed structure (2).

7. The automatic machine for cutting leathers according to claim 5, further comprising second motion means (20*h*, 20*j*), which operate to move said group between said rest configuration (K2) of reduced dimension and a rest configuration (K3) of minimum dimension, defined by a smaller distance between said group and the fixed structure (2).

8. The automatic machine for cutting leathers according to claim 5, further comprising a horizontal guide (6*h*, 6*j*), connected to said central body (1*a*), inside of which the articulation element (4*h*, 4*j*) slides, to move said group between said rest configuration (K2) of reduced dimension and said rest configuration (K3) of minimum dimension.

9. The automatic machine for cutting leathers according to claim 7, wherein said articulation element (4*h*, 4*j*) is connected to said second motion means (20*h*, 20*j*), to move said group between said rest configuration (K2) of reduced dimension and rest configuration (K3) of minimum dimension.

10. The automatic machine for cutting leathers according to claim 3, wherein said articulation element (4*h*, 4*j*) is situated in a region corresponding to the lower part of the central body (1*a*) and in that, at least when in said rest configuration (K2) of reduced dimension, said active surfaces (3*a*, 3*h*, 3*j*) of said central body (1*a*) and said lateral portion (1*h*, 1*j*) are arranged angular with respect to each other, to form at least one 90° angle.

11. The automatic machine for cutting leathers according to claim 1, includes first motion means (10*h*, 10*j*), which move said lateral portion (1*h*, 1*j*) between at least said working configuration (K1) and said rest configuration (K2) of reduced dimension.

12. The automatic machine for cutting leathers according to claim 1, wherein said lateral portion (1*h*, 1*j*) is a flat plate.

13. The automatic machine for cutting leathers according to claim 2, further comprising an articulation element (4*h*, 4*j*), with respect to which said lateral portion (1*h*, 1*j*) is made to rotate between said working configuration (K1) and rest configuration (K2) of reduced dimension, in which said central body active surface (3*a*) and said lateral portion active surfaces (3*h*, 3*j*) are arranged at an angle with respect to each other.

14. The automatic machine for cutting leathers according to claim 8, wherein said articulation element (4*h*, 4*j*) is connected to said second motion means (20*h*, 20*j*), to move said group between said rest configuration (K2) of reduced dimension and rest configuration (K3) of minimum dimension.

15. The automatic machine for cutting leathers according to claim 5, wherein said articulation element (4*h*, 4*j*) is situated in a region corresponding to the lower part of the central body (1*a*) and in that, at least when in said rest configuration (K2) of reduced dimension, said active surfaces (3*a*, 3*h*, 3*j*) of said central body (1*a*) and said lateral portion (1*h*, 1*j*) are arranged angular with respect to each other, to form at least one 90° angle.

16. The automatic machine for cutting leathers according to claim 2, further comprising first motion means (10*h*, 10*j*), which move said lateral portion (1*h*, 1*j*) between at least said working configuration (K1) and said rest configuration (K2) of reduced dimension.

17. The automatic machine for cutting leathers according to claim 3, further comprising first motion means (10*h*, 10*j*), which move said lateral portion (1*h*, 1*j*) between at least said working configuration (K1) and said rest configuration (K2) of reduced dimension.

* * * * *